US007327324B2

(12) United States Patent
Wang et al.

(10) Patent No.: US 7,327,324 B2
(45) Date of Patent: Feb. 5, 2008

(54) MONOPOLE SLOT ANTENNA

(75) Inventors: Hanyang Wang, Witney (GB); Ming Zheng, Farnborough (GB); Su Qing Zhang, Oxford (GB); Alan Johnson, Frimley (GB)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/498,577

(22) PCT Filed: Dec. 16, 2002

(86) PCT No.: PCT/IB02/05433

§ 371 (c)(1),
(2), (4) Date: Jan. 13, 2005

(87) PCT Pub. No.: WO03/052867

PCT Pub. Date: Jun. 26, 2003

(65) Prior Publication Data

US 2005/0116870 A1 Jun. 2, 2005

Related U.S. Application Data

(63) Continuation of application No. 10/020,195, filed on Dec. 18, 2001, now Pat. No. 6,618,020.

(51) Int. Cl.
*H01Q 13/10* (2006.01)

(52) U.S. Cl. ..... 343/767; 343/702

(58) Field of Classification Search ..... 343/767, 343/770, 700, 702, 829, 846, 700 MS
See application file for complete search history.

(56) References Cited

U.S. PATENT DOCUMENTS

| | | | | |
|---|---|---|---|---|
| 3,257,661 | A * | 6/1966 | Tanner | 343/792.5 |
| 4,723,305 | A | 2/1988 | Phillips et al. | 455/575.7 |
| 4,843,403 | A | 6/1989 | Lalezari et al. | 343/767 |
| 5,563,617 | A | 10/1996 | Redfern et al. | 343/767 |
| 5,646,637 | A | 7/1997 | Miller | 343/713 |
| 5,677,698 | A | 10/1997 | Snowdon | 343/770 |
| 6,031,503 | A | 2/2000 | Preiss, II et al. | 343/770 |
| 6,043,786 | A | 3/2000 | Vannatta et al. | 343/770 |
| 6,169,523 | B1 * | 1/2001 | Ploussios | 343/895 |
| 6,373,442 | B1 | 4/2002 | Thomas et al. | 343/767 |
| 6,414,642 | B2 | 7/2002 | Honda et al. | 343/702 |
| 6,424,300 | B1 | 7/2002 | Sanford et al. | 343/702 |
| 6,480,162 | B2 | 11/2002 | Sabet et al. | 343/767 |
| 6,483,466 | B2 * | 11/2002 | Liu | 343/702 |
| 6,600,448 | B2 * | 7/2003 | Ikegaya et al. | 343/700 MS |
| 6,618,020 | B2 * | 9/2003 | Wang et al. | 343/767 |

FOREIGN PATENT DOCUMENTS

| | | |
|---|---|---|
| EP | 0455493 A2 | 11/1991 |
| EP | 0455493 A3 | 11/1991 |
| EP | 0851530 A2 | 7/1998 |
| GB | 1018779 A2 | 7/2000 |

OTHER PUBLICATIONS

Patent Abstracts of Japan; Takahashi Hitoshi and Okano Yoshinobu; "Plate Antenna and Portable Communication Terminal Equipped with the Same and Broadcast Receiver"; Pub. No. 2002-246821, Pub. Date Aug. 30, 2002.

* cited by examiner

*Primary Examiner*—Tho Phan
(74) *Attorney, Agent, or Firm*—Harrington & Smith, PC

(57) ABSTRACT

A resonant monopole slot antenna comprising a ground plane, having a radiating slot which is dimensioned such that the slot is equivalent electromagnetically to an odd number of quarter wavelengths at the antenna's operating frequency, wherein the antenna's feed is arranged at the open end of the radiating slot.

21 Claims, 5 Drawing Sheets

2(a) 2(b)

MONOPOLE SLOT ANTENNA

This application is a continuation of Ser. No. 10/020,195, Dec. 18, 2001 now U.S. Pat. No. 6,618,020.

FIELD OF THE INVENTION

The present invention relates to a slot antenna.

BACKGROUND OF THE INVENTION.

Slot antennas have found wide application in the field of radio communication. Conventional slot antennas comprise halfwave elements. This has put them at a disadvantage, with regard to size, compared with patch or wire antennas, such as the PIFA (planar inverted-F antenna), which can be constructed with quarterwave elements.

Ideally, a wire monopole antenna or the like comprises a quarterwave radiating element perpendicular to an infinite ground plane. This configuration is in practice impossible to achieve. However, in some circumstances, such as a mobile phone, it is impossible even to approximate this configuration well because of other design constraints.

SUMMARY OF THE INVENTION

An object of the present invention is to provide a slot antenna that is not at a size disadvantage to PIFA antennas.

According to the present invention, there is provided a resonant monopole slot antenna including a radiating slot which is dimensioned such that the slot is equivalent electromagnetically to an odd number of quarter wavelengths at the antenna's operating frequency, wherein the antenna's feed is arranged at the open end of the radiating slot. Feeding the slot at its open end provides a broader usable bandwidth than feeding at a position towards the closed end.

Preferably the antenna's feed is provided at a position at which the maximum E-field occurs.

The radiating slot may be straight or not straight. If the slot is not straight, it may be, for example, L-shaped or meander.

Preferably, said odd number is 1.

Preferably, the radiating slot comprises an area of a printed circuit board which is free of conductor. More preferably, said area extends to an edge of the printed circuit board.

Preferably, said feed comprises a conductor extending along or parallel to the longitudinal axis or transversely across the radiating slot at its open end.

The feed may comprise a conductor, which could be any transmission line structure, but more preferably, said conductor comprises a signal line of a stripline or microstrip transmission line.

DETAILED DESCRIPTION OF THE INVENTION

Preferred embodiments of the present invention will now be described, by way of example only, with reference to the accompanying drawings.

Figure 1:
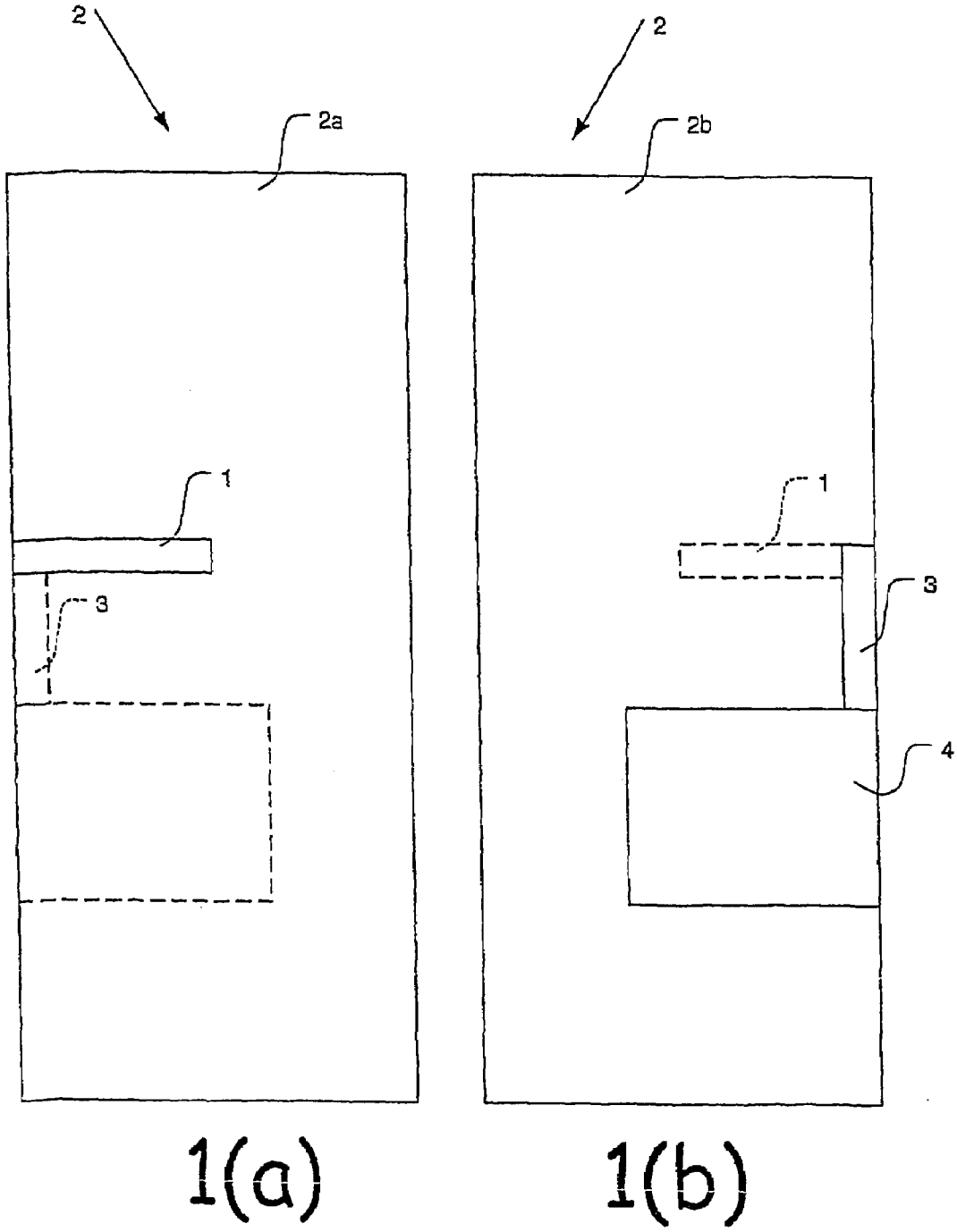
FIG. 1 shows the front (FIG. 1(*a*)) and back (FIG. 1(*b*)) of a PCB carrying a first antenna according to the present invention.

Referring to FIGS. 1(*a*) and 1(*b*), a slot antenna 1 is formed on a double-sided printed circuit board 2. The slot antenna 1 is formed by removing a strip of copper from a margin of the front side 2*a* of the printed circuit board 2. The front side 2*a* (FIG. 1(*a*)) of the printed circuit board 2 is otherwise an unbroken ground plane.

The back side 2*b* (FIG. 1(*b*)) of the printed circuit board 2 is devoid of copper save for a microstrip feed 3 to the slot antenna 1 and the tracks of a radio transmitter circuit 4.

The slot antenna 1 is open at the edge of the printed circuit board 2. In the present example, the length of the slot antenna is 12 mm and its width is 2 mm and the slot antenna resonates at 2451 MHz. This is approximately the same resonant frequency that would be expected for a closed slot antenna 24 mm long and 2 mm wide. Such a closed slot antenna is analogous to a halfwave dipole wire antenna and the present antenna can be viewed as analogous to a quarterwave monopole wire antenna. Consequently, the dimensions of slots with hereinafter be referred to by reference to the analogous wire antenna length.

The microstrip feed 3 to the slot antenna 1 extends along the edge of the printed circuit board 2, perpendicular to the slot antenna 1, FIG. 1. It is spaced apart from the groundplane, 2*a*. The microstrip feed 3 terminates behind the slot antenna 1. In this example, the microstrip feed 3 feeds the slot antenna 1 at its high impedance end. Feeding the antenna at the high impedance end in this way provides a good match over a larger bandwidth than can be achieved by feeding the slot at its low impedance end.

Figure 2:
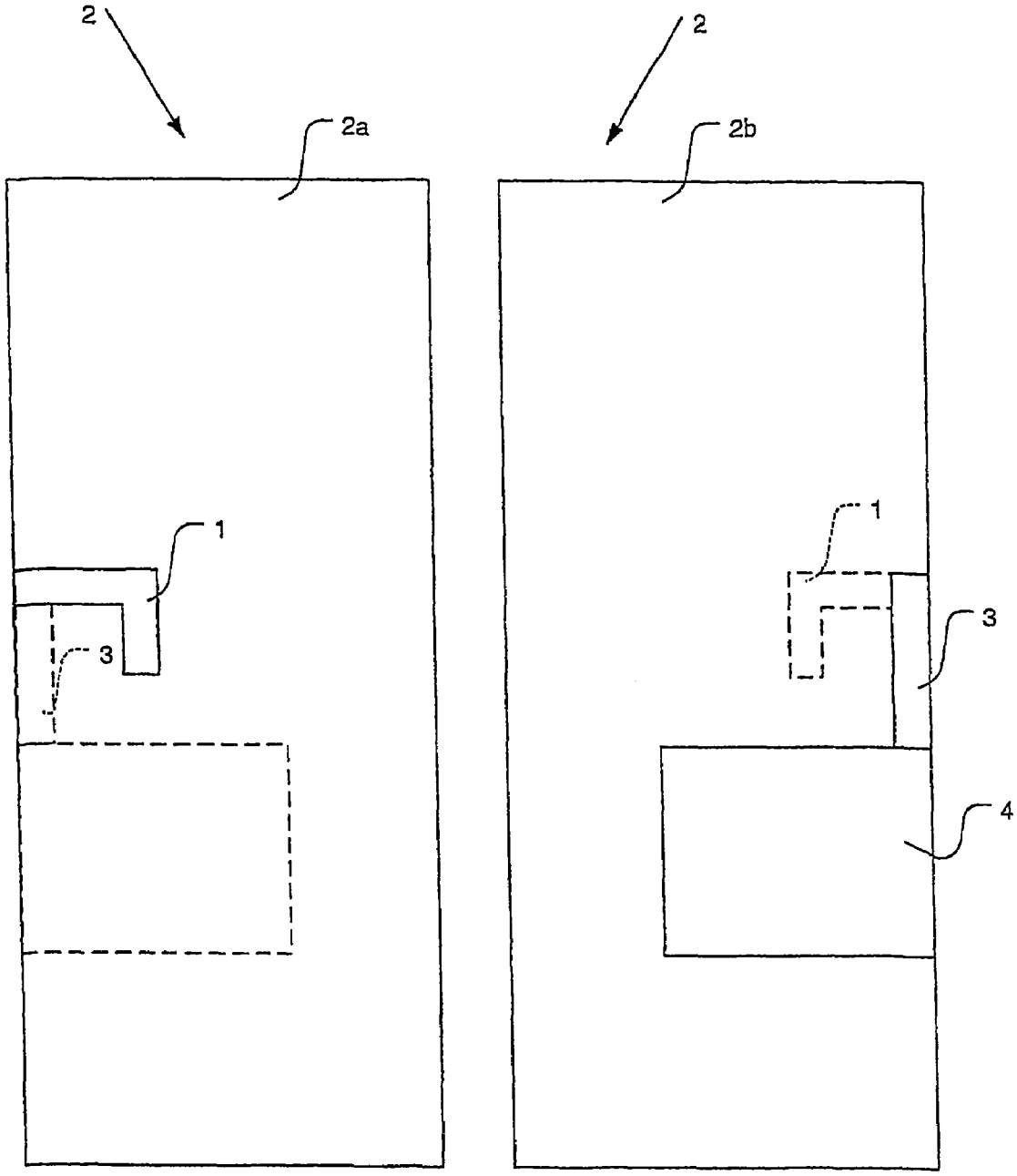
FIG. 2 shows the front (FIG. 2(*a*)) and back (FIG. 2(*b*)) of a PCB carrying a second antenna according to the present invention.

Referring to FIGS. 2(*a*) and 2(*b*), the straight slot of the antenna 1 of FIGS. 1(*a*) and 1(*b*) can be replaced by an L-shaped slot.

Figure 3:
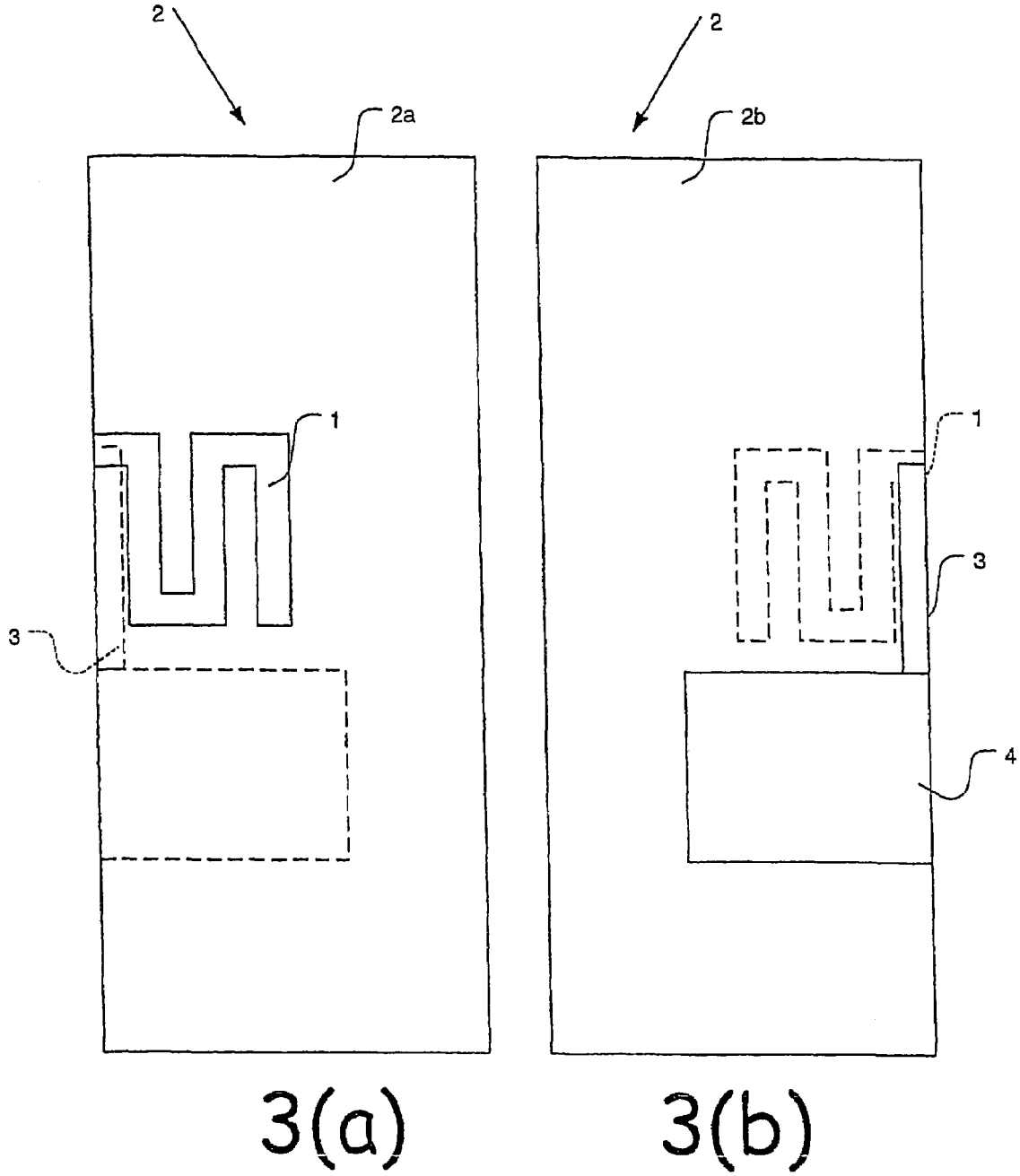
FIG. 3 shows the front (FIG. 3(*a*)) and back (FIG. 3(*b*)) of a PCB carrying a third antenna according to the present invention.

Referring to FIGS. 3(*a*) and 3(*b*), the straight slot of the antenna 1 of FIGS. 1(*a*) and 1(*b*) can be replaced by a meandering slot. The feed 3, is shown positioned at the maximum E-field position.

Figure 4:
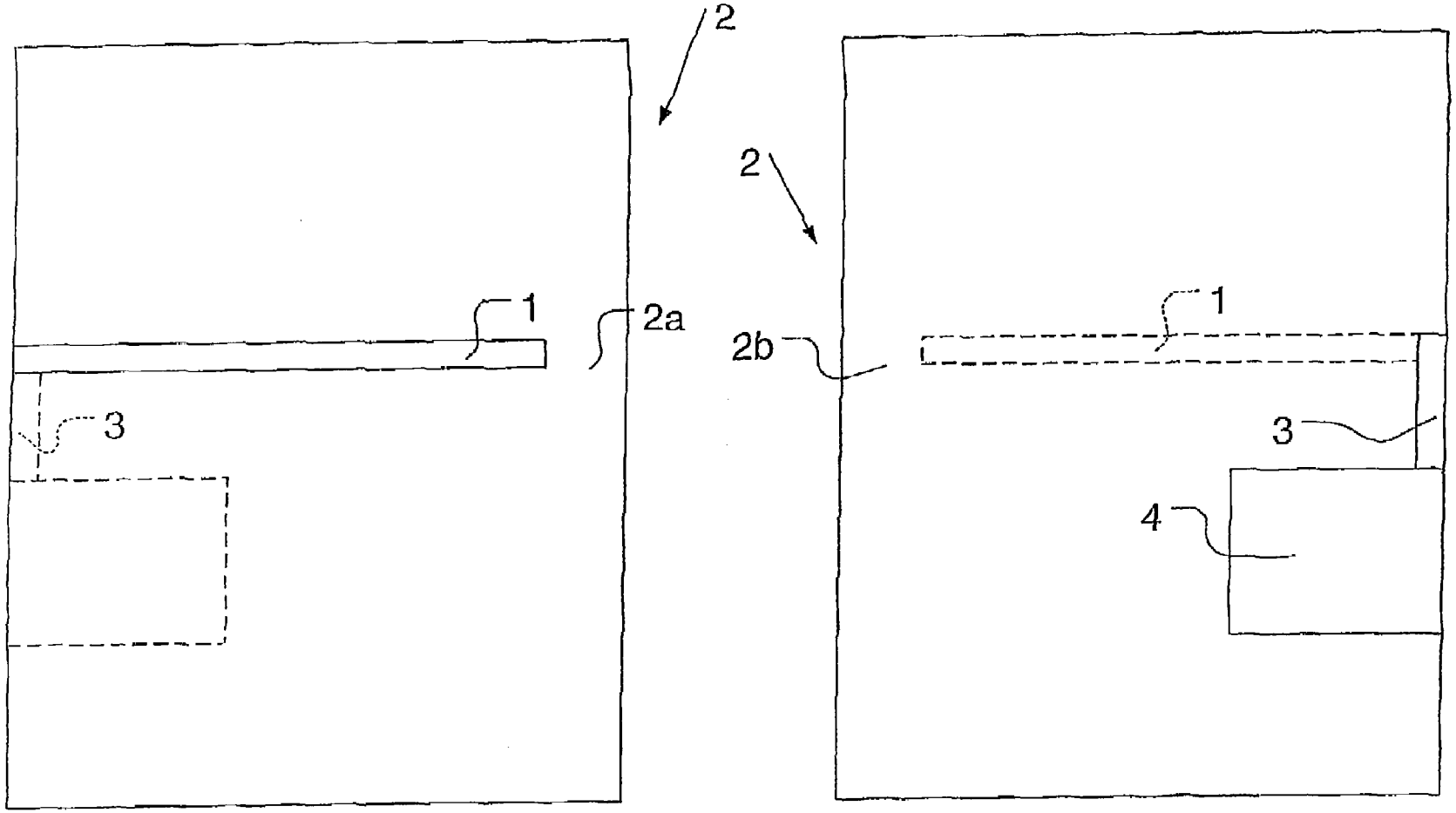
FIG. 4 shows the front (FIG. 4(*a*)) and back (FIG. 4(*b*)) of a PCB carrying a fourth antenna according to the present invention.

Referring to FIGS. 4(*a*) and 4(*b*), the "quarterwave" slot of the antenna 1 of FIGS. 1(*a*) and 1(*b*) can be extended by units of a "quarterwave", for instance to three "quarterwaves" as shown. In this case the longer length of slot is 36 mm. With the feed point at the open end of the slot, the antennas feed impedance will be high for lengths which are odd numbers of "quarterwaves" and low for even numbers of "quarterwaves".

Figure 5:
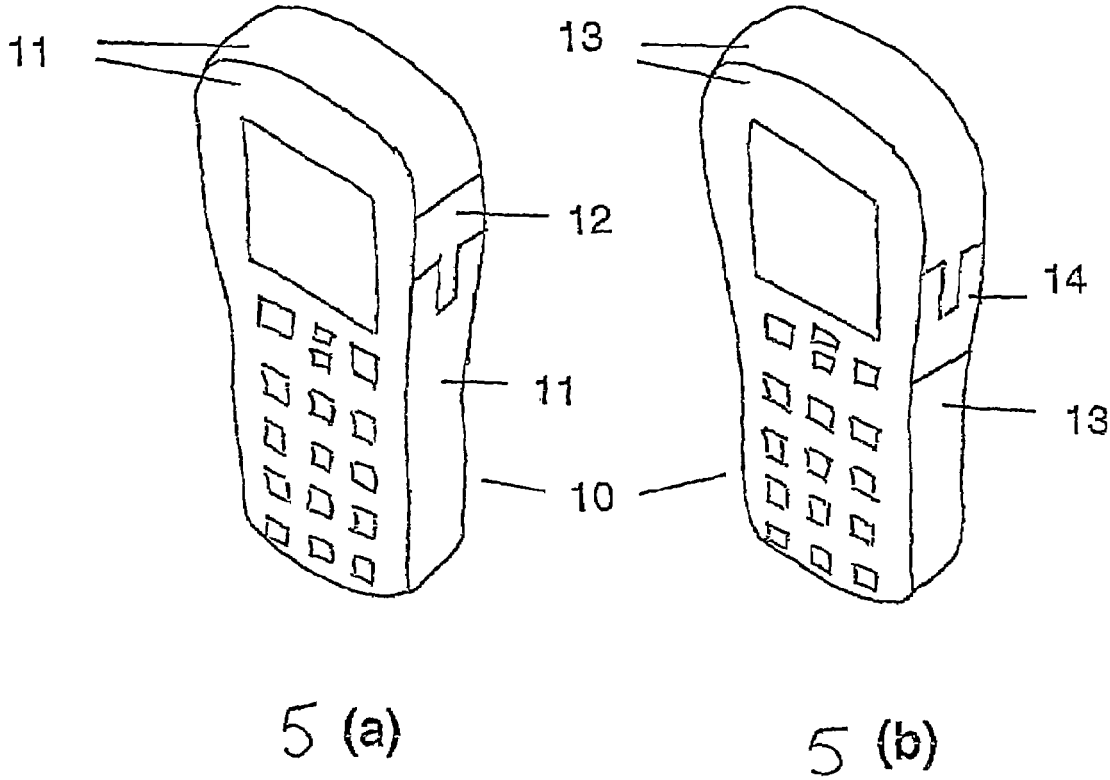
FIG. 5 shows metal (FIG. 5(*a*)) and plastic (FIG. 5(*b*)) radiotelephone casings having a slot antenna according to the present invention.

Radiotelephone handsets 10 may have largely metal 11 (FIG. 5(*a*)) or largely plastic 13 (FIG. 5(*b*)) casings. FIG. 5(*a*) shows the outer casing 11 of a handset 10 made from a metal such as steel (conductive material). The side of the handset 10 has a 'T' shape area 12 removed from it; (the shape of the removed area does not have to be a 'T' shape but may for example, be a meander shape). The base of the 'T' shape defines a slot in the metal casing 11 which can be used to provide a slot antenna, subject to arranging the feed section as described previously. In an alternative embodiment, the empty 'T' shape 12 in the side of the handset 10 may be filled in by a plastic (non-conductive) insert. Correspondingly, a side of a radio telephone 10 with a plastic casing 13 (FIG. 5(*b*)) may have a 'U' shaped metal insert 14 placed therein to again provide a slot antenna subject to appropriately arranging the feed sections as described previously.

Although reference to an outer casing is made the antenna could form part of an inner casing which is then covered by an exterior handset casing.

It will be appreciated that many modifications can be made to the above-described embodiments without departing from the spirit and scope of the claims appended hereto.

The invention claimed is:

1. A resonant monopole slot antenna comprising a ground plane, having a radiating slot which is dimensioned such that the slot is equivalent electromagnetically to an odd number of quarter wavelengths at the antenna's operating frequency, wherein the antenna's feed point is arranged at the open end of the radiating slot and situated so as to coincide with the maximum E field position of the antenna.

2. An antenna according to claim 1, wherein the radiating slot is straight.

3. An antenna according to claim 1, wherein the radiating slot is not straight.

4. An antenna according to claim 3, wherein said slot is L-shaped.

5. An antenna according to claim 3, wherein said slot meanders.

6. An antenna according to claim 1, wherein said odd number is 1.

7. An antenna according to claim 1, wherein the radiating slot comprises an area of a printed circuit board which is free of conductor.

8. An antenna according to claim 7, wherein said area extends to an edge of the printed circuit board.

9. An antenna according to claim 1, wherein said feed comprises a conductor extending transversely across the radiating slot at its open end.

10. An antenna according to claim 9, wherein said conductor comprises a signal line of a stripline or microstrip transmission line.

11. A radio communications device having a casing; the casing being arranged to be a resonant monopole slot antenna comprising a ground plane, having a radiating slot which is dimensioned such that the slot is equivalent electromagnetically to an odd number of quarter wavelengths at the antenna's operating frequency, wherein the antenna's feed is arranged at the open end of the radiating slot.

12. An antenna according to claim 11, wherein the casing is made from one or more conductive portions.

13. An antenna according to claim 11, wherein the groundplane is formed from a conductive part of the casing.

14. An antenna according to claim 11, wherein the slot is filled with a non-conductive portion of the casing.

15. A casing for a radio communications device, wherein the casing is arranged to be a resonant monopole slot antenna comprising a ground plane, having a radiating slot which is dimensioned such that the slot is equivalent electromagnetically to an odd number of quarter wavelengths at the antenna's operating frequency, wherein the antenna's feed is arranged at the open end of the radiating slot.

16. A means for resonating comprising a means for providing a ground plane, the means for resonating having a means for radiating dimensioned such that the means for radiating is equivalent electromagnetically to an odd number of quarter wavelengths at the operating frequency of the means for resonating, wherein the means for resonating comprises a means for feeding arranged at an open end of the means for radiating, and situated so as to coincide with the maximum E field position of the means for resonating.

17. The means for resonating of claim 16, wherein:

the means for resonating comprises a resonant antenna;

the means for providing a ground plane comprises a ground plane;

the means for radiating comprises a radiating slot; and the means for feeding comprises a feed.

18. A device for providing radio communications, the device having a means for casing, the means for casing being arranged to act as a means for resonating and comprising a means for providing a ground plane, and having a means for radiating which is dimensioned such that the means for radiating is equivalent electromagnetically to an odd number of quarter wavelengths at the operating frequency of the means for resonating, and wherein the means for casing comprises a means for feeding arranged at an open end of the means for radiating.

19. The device of claim 18, wherein:

the means for casing comprises a casing of the device;

the means for resonating comprises a resonant antenna;

the means for providing a ground plane comprises a ground plane;

the means for radiating comprises a radiating slot; and the means for feeding comprises an antenna feed.

20. A means for casing a device for providing radio communications, the means for casing being arranged to act as a means for resonating, the means for casing comprising a means for providing a ground plane and having a means for radiating which is dimensioned such that the means for radiating is equivalent electromagnetically to an odd number of quarter wavelengths at the operating frequency of the means for resonating, and wherein the means for casing comprises a means for feeding arranged at an open end of the means for radiating.

21. The means for casing of claim 20, wherein:

the means for casing comprises a casing of the device;

the means for resonating comprises a resonant antenna;

the means for providing a ground plane comprises a ground plane;

the means for radiating comprises a radiating slot; and the means for feeding comprises an antenna feed.

* * * * *